US011596196B2

(12) United States Patent
Chang et al.

(10) Patent No.: US 11,596,196 B2
(45) Date of Patent: Mar. 7, 2023

(54) ARTICLE OF FOOTWEAR WITH FLAP STRAP

(71) Applicant: NIKE, Inc., Beaverton, OR (US)

(72) Inventors: Leo S. Chang, Portland, OR (US); Derek Houng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/169,966

(22) Filed: Feb. 8, 2021

(65) Prior Publication Data

US 2021/0244126 A1 Aug. 12, 2021

Related U.S. Application Data

(60) Provisional application No. 62/975,156, filed on Feb. 11, 2020.

(51) Int. Cl.
*A43B 23/08* (2006.01)
*A43B 3/06* (2006.01)

(52) U.S. Cl.
CPC ..... *A43B 3/06* (2013.01); *A43B 23/088* (2013.01)

(58) Field of Classification Search
CPC ..... A43B 23/088; A43B 23/08; A43B 5/02; A43B 3/06; A43B 7/20; A43B 7/24; A43C 5/00
See application file for complete search history.

(56) References Cited

U.S. PATENT DOCUMENTS 2,789,374 A * 4/1957 Planert ..... A63B 71/1225 36/89
3,234,667 A * 2/1966 Bovay ..... A43B 5/025 36/113
4,577,419 A * 3/1986 Chassaing ..... A43C 11/1493 36/114
4,670,998 A * 6/1987 Pasternak ..... A43B 5/00 36/114
4,811,500 A * 3/1989 Maccano ..... A43B 5/00 36/117.9
5,271,130 A * 12/1993 Batra ..... A43B 23/0235 24/714.6
5,319,869 A * 6/1994 McDonald ..... A43B 5/00 36/114
5,408,761 A * 4/1995 Gazzano ..... A43B 5/00 36/102
5,430,959 A * 7/1995 Mitsui ..... A43B 5/00 36/114

(Continued)

FOREIGN PATENT DOCUMENTS

GB 2315980 A * 2/1998 ..... A43B 5/00

*Primary Examiner* — Jillian K Pierorazio
(74) *Attorney, Agent, or Firm* — Quinn IP Law

(57) ABSTRACT

An article of footwear includes a sole structure and an upper coupled to the sole structure. The upper includes a forefoot region, a heel region, and a midfoot region disposed between. The upper defines a throat opening sized to receive a foot. The upper includes a main upper body and a strap coupled to the main upper body, wherein the strap extends from the midfoot region of the upper at the throat opening, down toward the heel region of the upper, wherein the strap is configured to provide stability, and the strap is configured to keep a wearer's heel contained down and back in the article of footwear.

11 Claims, 6 Drawing Sheets

(56) References Cited

U.S. PATENT DOCUMENTS 5,463,822 A * 11/1995 Miller ..... A43C 11/00 36/50.1
5,497,564 A * 3/1996 Allen ..... A43C 5/00 24/713.7
5,533,279 A 7/1996 Mitsui et al.
5,564,203 A * 10/1996 Morris ..... A43B 23/22 36/136
D383,513 S * 9/1997 Ryan ..... D2/973
5,692,319 A * 12/1997 Parker ..... A43B 7/1495 36/114
5,992,057 A * 11/1999 Monti ..... A43B 5/02 36/50.1
6,128,835 A * 10/2000 Ritter ..... A43C 1/00 36/114
6,823,610 B1 * 11/2004 Ashley ..... A43B 3/0078 36/51
7,062,867 B2 * 6/2006 Meibock ..... A43B 1/0072 36/50.1
D533,987 S * 12/2006 Matis ..... D2/969
9,113,675 B2 * 8/2015 DeHaven ..... A43B 13/141
11,122,861 B2 * 9/2021 Tresser ..... A43B 21/32
11,351,051 B1 * 6/2022 Ostergard ..... A43B 7/20
2002/0148142 A1 * 10/2002 Oorei ..... A43C 1/00 36/129
2004/0181972 A1 * 9/2004 Csorba ..... A43C 11/14 36/50.1
2006/0032090 A1 * 2/2006 Chen ..... A43C 11/14 36/58.5
2006/0117607 A1 * 6/2006 Pare ..... A43C 11/004 36/50.1
2014/0005585 A1 * 1/2014 Berns ..... A43B 7/20 602/27
2015/0257489 A1 * 9/2015 Trudel ..... A43C 11/20 24/68 SK
2016/0174661 A1 * 6/2016 Nonogawa ..... A43B 23/0235 36/88
2016/0302524 A1 * 10/2016 Smith ..... A43C 1/04
2016/0345673 A1 * 12/2016 Humphrey ..... A43B 13/125
2017/0065028 A1 * 3/2017 Foster ..... A43C 7/00
2019/0021444 A1 1/2019 Humphrey et al.

* cited by examiner

ARTICLE OF FOOTWEAR WITH FLAP STRAP

CROSS REFERENCE TO RELATED APPLICATIONS

The present application claims the benefit of priority from U.S. Provisional Patent No. 62/975,156, filed 11 Feb. 2020, which is incorporated by reference in its entirety.

TECHNICAL FIELD

The present teachings generally relate to a sole structure for an article of footwear and, more particularly, to an upper including a flap strap.

BACKGROUND

This section provides background information related to the present disclosure which is not necessarily prior art.

Articles of footwear include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

The metatarsophalangeal (MTP) joint of the foot is known to absorb energy as it flexes through dorsiflexion during running movements. As the foot does not move through plantarflexion until the foot is pushing off of a ground surface, the MTP joint returns little of the energy it absorbs to the running movement and, thus, is the source of an energy drain during running movements. Embedding flat and rigid plates having longitudinal stiffness within a sole structure increases the overall stiffness thereof.

SUMMARY

An article of footwear includes a sole structure and an upper coupled to the sole structure. The upper includes a main upper body or shell and a containment strap coupled to the main upper body. The strap extends from the midfoot region of the upper at the throat opening, down toward the heel region of the upper. The strap is configured to provide stability, and the strap is configured to draw a wearer's heel down and back into the article of footwear.

An ancillary piece of material is affixed to an external surface of the main upper body at a first location at a second location. The ancillary piece of material includes a central region between the first location and the second location that is not directly attached to the main upper body. This central region defines a guide to slidably receive the containment strap between the ancillary piece of material and the main upper body. In some embodiments, this ancillary piece of material may comprise a corporate logo affixed to the upper.

BRIEF DESCRIPTION OF THE DRAWINGS

Embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
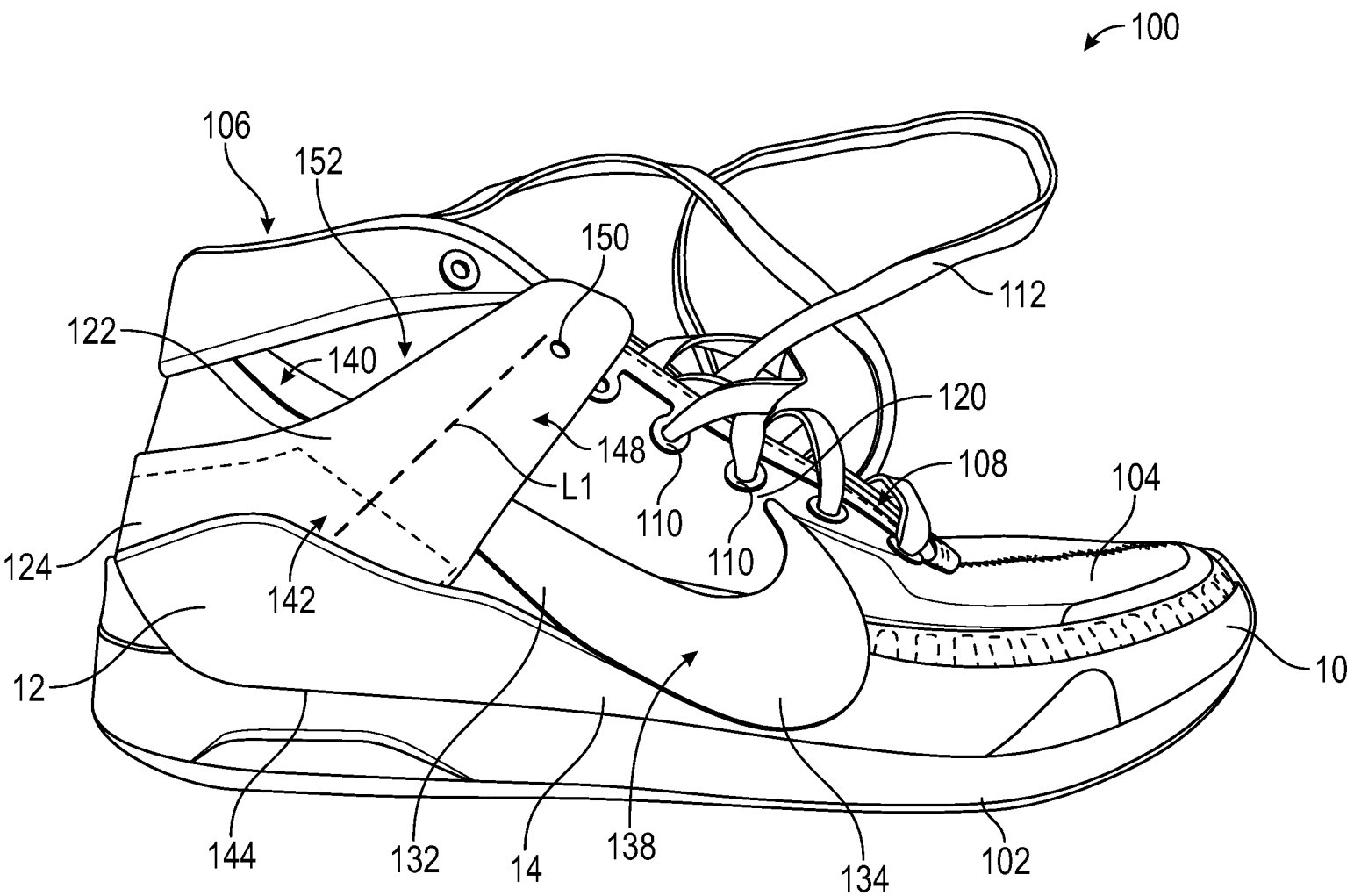
FIG. 1 is a lateral side view of an article of footwear having a flap strap extending exterior to a logo.
Figure 2:
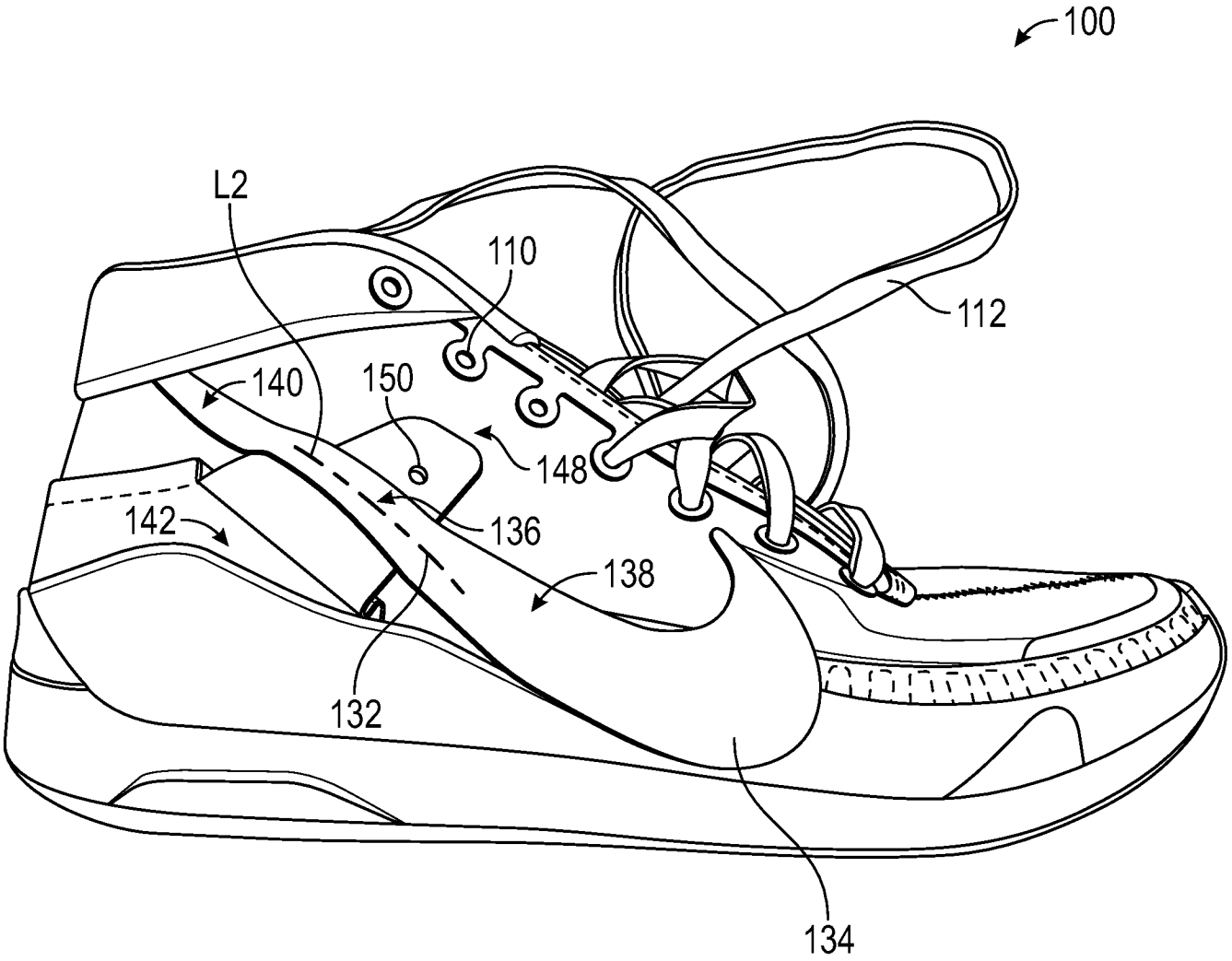
FIG. 2 is a lateral side view of the article of footwear of FIG. 1, with the strap being withdrawn from behind the logo.
Figure 3:
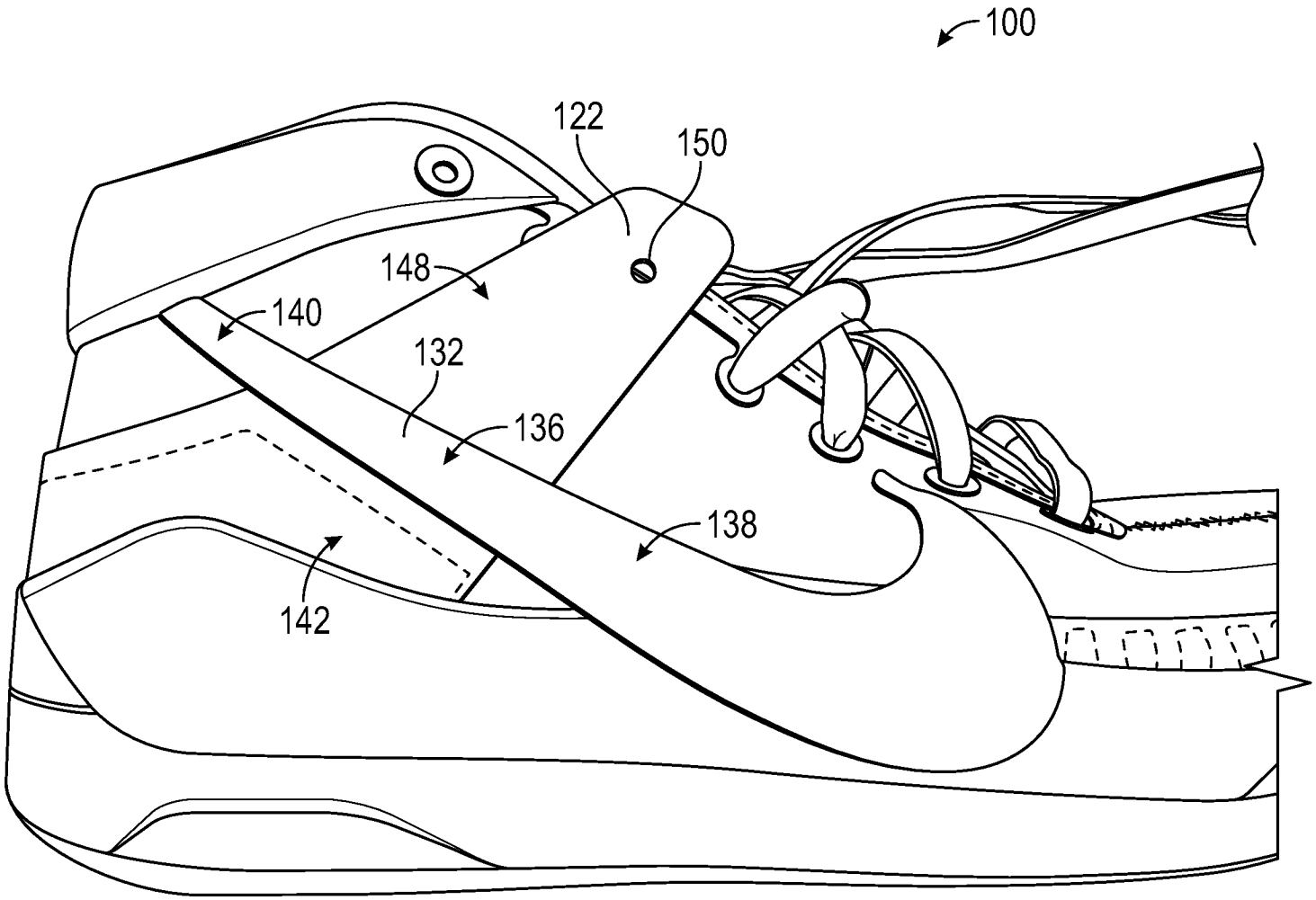
FIG. 3 is a lateral side view of the article of footwear of FIGS. 1 and 2, with the strap extending interior to the logo.

The present disclosure describes an article of footwear, which may be used for baseball. In some aspects of the present disclosure, The above features and advantages and other features and advantages of the present teachings are readily apparent from the following detailed description of the modes for carrying out the present teachings when taken in connection with the accompanying drawings.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

The present disclosure generally relates to an article of footwear (e.g., a shoe) that has a unique containment system that is designed to provide movable support while not obstructing graphical indicia or logos provided on a sidewall. In the illustrated examples, the present containment system includes a strap that extends in a forward direction from a heel counter of the shoe, though is movably or slidably positioned within a guide formed by an ancillary piece of material that may be fashioned as a logo. In some embodiments, the forward extending strap may include an aperture that aligns with an eyestay of the shoe and is adapted to receive a lace. As the lace is tightened by the user, the foot may be drawn rearward into a more stable engagement with the heel counter. During use, the floating nature of the strap relative to the sidewall may enable limited lateral flexibility while maintaining containment throughout.

In other embodiments of the design, the strap may extend from any portion of the biteline of the shoe (i.e., the location where the upper meets the sole structure) and may slidably pass behind an ancillary attached piece of material, that may be fashioned as an indicia or logo. In doing so, the foot of the wearer may be firmly held to the sole while not obstructing the visual impression of the shoe or logo.

With reference to FIGS. 1-6, an article of footwear 100 includes a sole structure 102 and an upper 104 coupled to the sole structure 102. The upper 104 includes a forefoot region 10, a heel region 12, and a midfoot region 14 disposed between the forefoot region 10 and the heel region 12. The upper 104 defines an ankle opening 106 (FIG. 5) adapted to permit a foot of the wearer to enter the interior cavity of the upper and a throat opening 108 extending from the ankle opening toward the forefoot region 10. The throat opening 108 may be designed to controllably splay open to permit easier ingress/egress of the foot to/from the upper. The upper may further include a plurality of eyelets/eyestays 110 extending through the thickness of the wall of the upper and provided on opposing sides of the throat opening 108. The plurality of eyelets/eyestays 110 may receive a lace 112 that is operatively threaded across the throat opening 108. When drawn tight, the lace 112 may reduce the width of the throat opening 108 to provide a tension fit of the upper about the foot of the wearer.

The upper 104 of the present design includes a main upper body 120 and a containment strap 122 coupled to the main upper body 120. In one embodiment, the containment strap 122 extends from a heel counter 124 provided in the lower heel region 12 of the upper upward toward the the midfoot region 14 of the upper 104 at the throat opening 108. The containment strap 122 is configured to provide stability to the foot of the wearer by drawing the foot down and back into the sole and heel counter 124 in the article of footwear 100. In general, at least a portion of the containment strap 122 may remain unattached or free floating relative to the wall of the main upper body 120. Doing so may permit suitable containment while not unduly stiffening the sidewall of the upper.

To permit this unattached containment strap configuration while also not allowing the strap 122 to simply fall away from the main body of the upper when not engaged, the present design may utilize a guide 132 formed by an ancillary piece of material 134 that is attached to the wall of the main upper body 120. This ancillary piece of material 134 may serve a dual purpose as an indicia or logo, and the present configuration may further permit this indicia or logo to remain unobstructed from external view. The guide 132 includes a central section 136 (best shown in FIG. 3) that is not directly attached to the upper. Said another way, the guide 132 may be a discrete piece of material that extends across a length of the upper 104 and that is secured to the upper in at least two, physically separated locations or regions (e.g., a forward location 138 and a rearward location 140). Between these locations or regions 138, 140, the guide 132 may be devoid of any permanent attachment means (i.e., stitching, staking, gluing, fusing, etc), such that the guide 132 and upper 104 form a channel through which the strap 122 may pass. During normal use, the strap 122 may be inserted through this channel between the guide 132 and the main upper body 120. The strap 122 extends a longitudinal axis L1 (i.e., a primary tensile axis) that is transverse to a longitudinal axis L2 of the guide 132. In some embodiments, as noted above, the guide 132 may comprise a logo (e.g., a swoosh)

In some embodiments, the strap 122 is permanently attached to the upper at a region 142 of the upper that is between the guide 132 and the sole 102. In some embodiments, the strap 122 may be secured at the biteline 144 of the article of footwear, which is defined as the line where the upper 100 meets the sole 102. Conversely, the strap 122 may lack any permanent attachment in the region 148 between the guide 132 and the throat opening 108. At the intersection/overlap of the guide 132 and the strap 122, neither may be directly secured to the main body of the upper 108.

Figure 4:
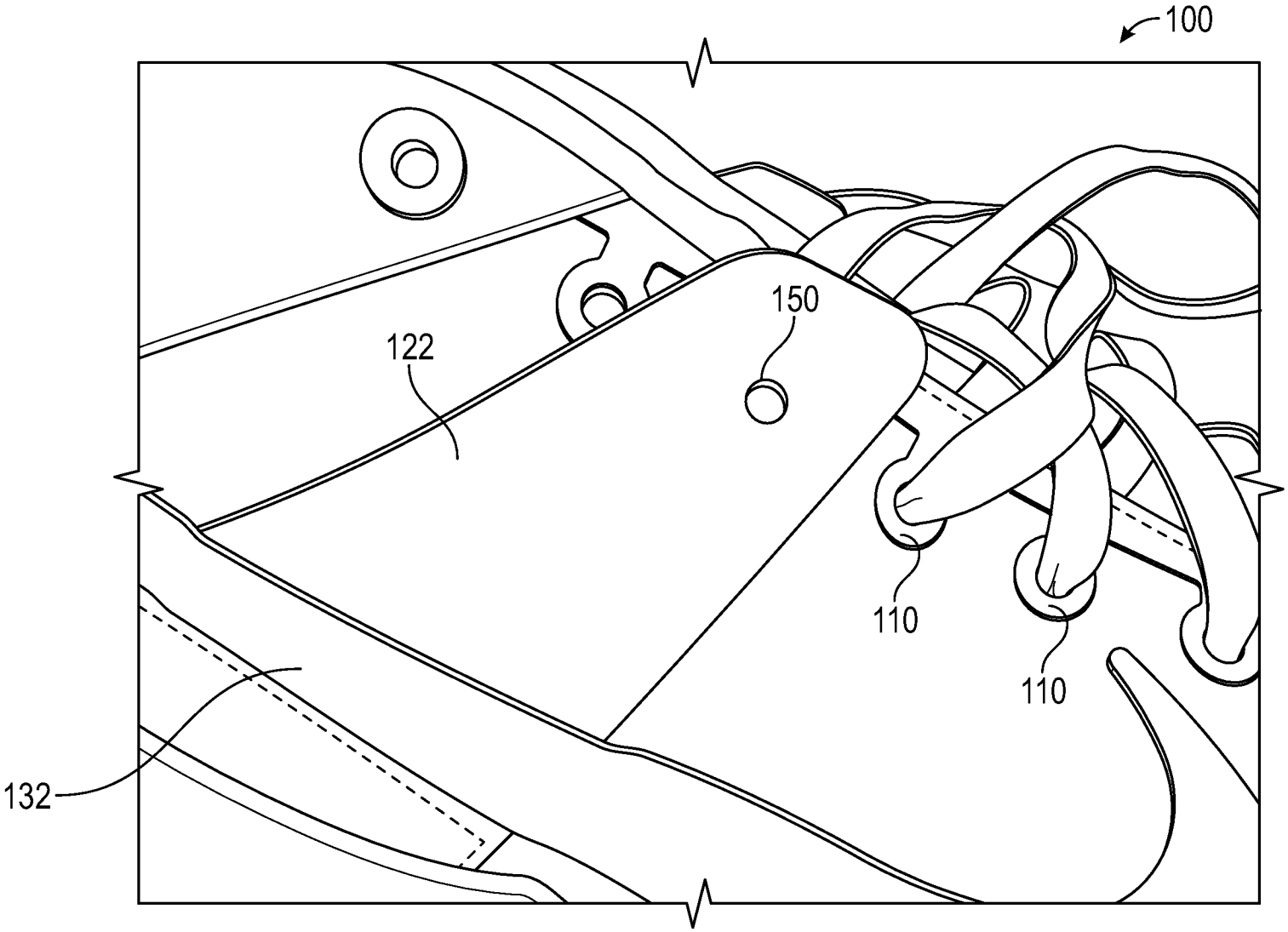
FIG. 4 is an enlarged view of a portion of the article of footwear of FIG. 3, showing alignment of an eyelet of the strap with an eyelet of the upper.
Figure 5:
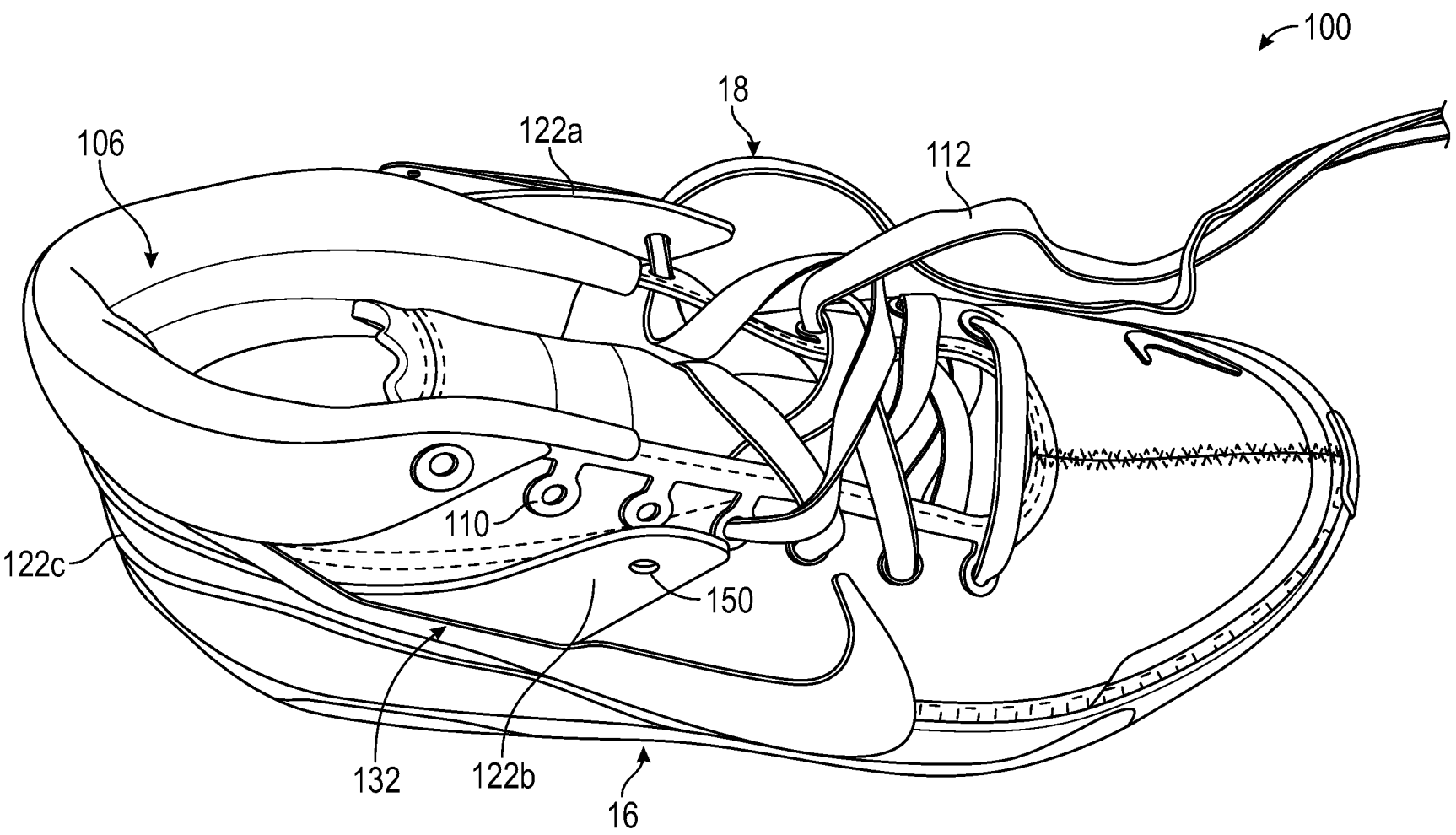
FIG. 5 is a top lateral perspective view of the article of footwear of FIG. 3.
Figure 6:
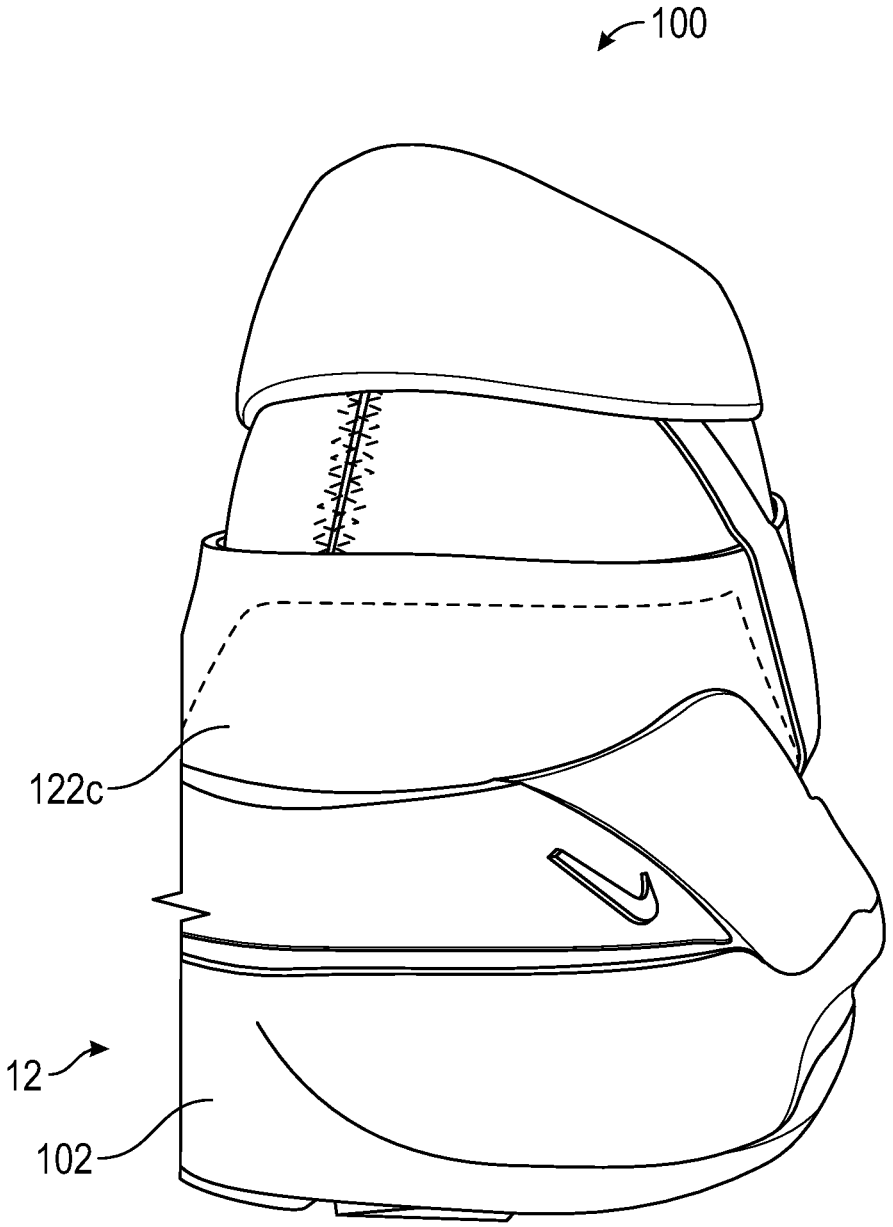
FIG. 6 is a rear lateral side view of the article of footwear of FIG. 3.

The strap 122 may include an eyelet 150 that is aligned with a corresponding eyelet 110 of the upper 10 (see FIG. 4). In this manner, a lace 112 of the shoe may jointly pass through both eyelets 110, 150 to jointly apply a tension through both elements.

The guide 132 and the strap 122 collectively form a strap/guide assembly 152. The strap/guide assembly 152 is disposed on a lateral side 16 of the upper 104, a medial side 18 of the upper 104, or both. In some embodiments, the strap 122 may encircle the heel region 12 while including a medial strap portion 122*a* on a medial side 18 of the upper 104, a lateral strap portion 122*b* on a lateral side 16 of the upper 104, and a connecting strap portion 122*c* connecting the medial strap portion 122*a* and the lateral strap portion 122*b*. The connecting strap portion 122*c* may extend around and be permanently secured to the heel region 12 of the upper 104, for example to reinforce or otherwise embellish the heel counter.

In other embodiments, the strap 122 may be a medial strap located at a medial side 18 of the upper 104, and the upper 104 further includes a lateral strap located at the lateral side 16 of the upper 104. In this embodiment, each of the lateral strap and the medial strap is discrete and is individually attached to the upper 104. The lateral strap is individually attached to the lateral strap of the upper, and the medial strap is individually attached to the medial side 18 of the upper 104. The strap 122 may be permanently attached below the guide 132.

In some embodiments, the strap 122 is attached to the article of footwear 100 at the biteline 144 between the upper and a midsole without necessarily having another permanent attachment (stitching) on the upper below the guide 132.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

Aspects and embodiments of the present disclosure and present designs are further provided in the following clauses, which should be read as a non-limiting part of the disclosure in view of the provided figures.

Clause 1: An article of footwear, comprising: a sole structure; and an upper coupled to the sole structure, wherein the upper includes a forefoot region, a heel region, and a midfoot region disposed between the heel region and the forefoot region, the upper defines an ankle opening sized to receive a foot and a throat opening extending from the ankle opening toward the forefoot, and the upper includes: a main upper body; a containment strap coupled to the main upper body, wherein the strap extends from the midfoot region of the upper at the throat opening, down toward the heel region of the upper, wherein the strap is configured to provide stability, and the strap is configured to keep a wearer's heel contained down and back in the article of footwear; and an ancillary piece of material affixed to an external surface of the main upper body at a first location at a second location, the ancillary piece of material including a central region between the first location and the second location that is not directly attached to the main upper body; and wherein the central region defines a guide to slidably receive the containment strap between the ancillary piece of material and the main upper body.

Clause 2: The article of footwear of clause 1, wherein the containment strap is permanently affixed to the upper only at a location between the guide and the sole structure.

Clause 3: The article of footwear of clause 2, wherein the containment strap is permanently affixed to a heel counter provided in the heel region.

Clause 4: The article of footwear of clause 3, wherein the containment strap includes a medial strap portion extending on a medial side of the throat opening, a lateral strap portion extending on a lateral side of the throat opening, and a connecting strap portion connecting the medial strap portion and the lateral strap portion, the connecting strap portion extends around the heel region of the upper and is permanently secured to the heel counter.

Clause 5: The article of footwear of any of clauses 1-4, wherein the ancillary piece of material extends from the heal region toward the forefoot region and in a direction that is about parallel to the throat opening.

Clause 6: The article of footwear of any of clauses 1-5, where ancillary piece of material is a corporate logo.

Clause 7: The article of footwear of any of clauses 1-6, wherein the upper further comprises a plurality of eyelets disposed on opposite sides of the throat opening and wherein the containment strap includes an aperture that is configured to align with one of the plurality of eyelets such that a lace may pass through the aperture and aligned eyelet.

Clause 8: The article of footwear of any of clauses 1-7, wherein the strap extends a longitudinal axis that is transverse to a longitudinal axis of the guide.

Clause 9: The article of footwear of any of clauses 1-8, wherein the guide and the strap collectively form a strap/guide assembly, and the strap/guide assembly is disposed on a lateral side of the upper, a medial side of the upper, or both.

Clause 10: The article of footwear of clause 1, wherein the strap is a medial strap located at a medial side of the upper, the upper further includes a lateral strap located at a lateral side of the upper, each of the lateral strap and the medial strap is discrete and is individually attached to the upper, the lateral strap is individually attached to the lateral side of the upper, and the medial strap is individually attached to the medial side of the upper.

Clause 11: The article of footwear of any of clauses 1-10, wherein the containment strap is not permanently attached to the main upper body within the guide or between the guide and an end of the containment strap opposite the sole structure.

Clause 12: The article of footwear of any of clauses 1-11, wherein the ancillary piece of material is affixed to the external surface of the main upper body at the first location at the second location via stitching or an adhesive.

Clause 13: The article of footwear of any of clauses 1-12, wherein the containment strap has a width of between 1.0 cm and 4.0 cm and tapers from a comparatively wider width at a first end to a comparatively narrower width at a second end, the second end being located closer to the throat opening than the first end.

What is claimed is:

1. An article of footwear, comprising:

a sole structure; and an upper coupled to the sole structure, wherein the upper includes a forefoot region, a heel region, and a midfoot region disposed between the heel region and the forefoot region, the upper defines an ankle opening sized to receive a foot and a throat opening extending from the ankle opening toward the forefoot region, and the upper includes:

a main upper body;

a containment strap coupled to the main upper body, wherein the containment strap extends from the midfoot region of the upper at the throat opening, down toward the heel region of the upper, wherein the containment strap is configured to provide stability, and the containment strap is configured to draw a wearer's heel down and back in the article of footwear when tensioned via a lace extending across the throat opening, and wherein the containment strap is permanently attached to the main upper body within the heel region;

an ancillary piece of material affixed to an external surface of the main upper body at a first location and at a second location, the ancillary piece of material including a central region between the first location and the second location that is not directly attached to the main upper body;

wherein the first location and second location are disposed on opposing sides of the containment strap such that the central region defines a guide to slidably receive the containment strap between the ancillary piece of material and the main upper body, and wherein the containment strap makes flush contact with the main upper body on an inner side of the containment strap and makes flush contact with the ancillary piece of material on an outer side of the containment strap when the containment strap is provided within the guide;

wherein the upper further comprises a plurality of eyelets disposed on opposite sides of the throat opening and wherein the containment strap includes an aperture that is configured to align with one of the plurality of eyelets such that a lace may pass through the aperture and aligned eyelet; and wherein the containment strap is not permanently attached to the main upper body within the guide or between the guide and the throat opening.

2. The article of footwear of claim 1, wherein the containment strap is permanently affixed to the upper only at a location between the guide and the sole structure.

3. The article of footwear of claim 2, wherein the containment strap is permanently affixed to a heel counter provided in the heel region.

4. The article of footwear of claim 3, wherein the containment strap includes a medial strap portion extending on a medial side of the throat opening, a lateral strap portion extending on a lateral side of the throat opening, and a connecting strap portion connecting the medial strap portion and the lateral strap portion, the connecting strap portion extends around the heel region of the upper and is permanently secured to the heel counter.

5. The article of footwear of claim 1, wherein the ancillary piece of material extends from the heel region toward the forefoot region and in a direction that is parallel to the throat opening.

6. The article of footwear of claim 1, where ancillary piece of material is a corporate logo.

7. The article of footwear of claim 1, wherein the containment strap extends a longitudinal axis that is transverse to a longitudinal axis of the guide.

8. The article of footwear of claim 1, wherein the guide and the containment strap collectively form a strap/guide assembly, and the containment strap/guide assembly is disposed on a lateral side of the upper, a medial side of the upper, or both.

9. The article of footwear of claim 1, wherein the containment strap is a medial strap located at a medial side of the upper, the upper further includes a lateral strap located at a lateral side of the upper, each of the lateral strap and the medial strap is discrete and is individually attached to the upper, the lateral strap is individually attached to the lateral side of the upper, and the medial strap is individually attached to the medial side of the upper.

10. The article of footwear of claim 1, wherein the ancillary piece of material is affixed to the external surface of the main upper body at the first location at the second location via stitching or an adhesive.

11. The article of footwear of claim 1, wherein the containment strap has a width of between 1.0 cm and 4.0 cm and tapers from a comparatively wider width at a first end to a comparatively narrower width at a second end, the second end being located closer to the throat opening than the first end.

* * * * *